US009050489B2

(12) United States Patent
Bell

(10) Patent No.: US 9,050,489 B2
(45) Date of Patent: Jun. 9, 2015

(54) AQUATIC TRAINING DEVICE

(75) Inventor: Peter James Bell, Chelmer (AU)

(73) Assignee: DR. PETER BELL & ASSOCIATES PTY LTD, Queensland (AU)

( * ) Notice: Subject to any disclaimer, the term of this patent is extended or adjusted under 35 U.S.C. 154(b) by 0 days.

(21) Appl. No.: 14/004,631

(22) PCT Filed: Mar. 9, 2012

(86) PCT No.: PCT/AU2012/000254
§ 371 (c)(1),
(2), (4) Date: Oct. 24, 2013

(87) PCT Pub. No.: WO2012/122591
PCT Pub. Date: Sep. 20, 2012

(65) Prior Publication Data

US 2014/0038791 A1 Feb. 6, 2014

(30) Foreign Application Priority Data

Mar. 11, 2011 (AU) ..... 2011900883
Mar. 9, 2012 (AU) ..... 2012229876

(51) Int. Cl.

| | |
|---|---|
| ***A63B 69/12*** | (2006.01) |
| ***A63B 21/008*** | (2006.01) |
| ***A63B 21/00*** | (2006.01) |
| ***A63B 69/06*** | (2006.01) |
| ***A63B 69/14*** | (2006.01) |

(52) U.S. Cl.

CPC ..... *A63B 21/0084* (2013.01); *A63B 21/00069* (2013.01); *A63B 21/1419* (2013.01); *A63B 69/06* (2013.01); *A63B 69/14* (2013.01); *A63B 2069/068* (2013.01); *A63B 2209/10* (2013.01); *A63B 2225/01* (2013.01); *A63B 2225/605* (2013.01); *A63B 69/12* (2013.01)

(58) Field of Classification Search

CPC ..... A63B 21/0084; A63B 21/00069; A63B 21/1419; A63B 69/12
USPC ..... 482/51, 55–56, 148, 74, 111; 244/138 R, 142–143, 145, 153 R; 114/102.1–102.15, 102.22–102.27, 114/293–294, 311; 43/9.1, 11, 27.4; 434/254; D12/215; 428/543
See application file for complete search history.

(56) References Cited

U.S. PATENT DOCUMENTS

| | | | | | |
|---|---|---|---|---|---|
| 2,510,186 | A | * | 6/1950 | Marsico et al. | 224/601 |
| 2,664,660 | A | * | 1/1954 | Larsson | 43/9.1 |
| 2,921,397 | A | * | 1/1960 | Luthi | 43/7 |
| 2,971,284 | A | * | 2/1961 | Opel | 43/11 |
| 3,012,351 | A | * | 12/1961 | Vieaux | 43/12 |
| 3,316,670 | A | * | 5/1967 | Johnson | 43/9.1 |

(Continued)

FOREIGN PATENT DOCUMENTS

| | | |
|---|---|---|
| SU | 1459679 | 2/1989 |
| WO | 2006/117827 | 11/2006 |

*Primary Examiner* — Loan H Thanh
*Assistant Examiner* — Andrew S Lo
(74) *Attorney, Agent, or Firm* — Hunter Clark PLLC

(57) ABSTRACT

An aquatic training device (150) including: a drag member (160) including an inlet (161), an outlet (162) and at least one side wall (163) extending between the inlet (161) and the outlet (162); and a link (170), for towing the drag member (160), coupled to the at least one side wall (163) adjacent the inlet (161); wherein the drag member (160) includes at least one drag inducer (164) formed in or attached to the at least one side wall (163).

20 Claims, 9 Drawing Sheets

(56) References Cited

U.S. PATENT DOCUMENTS

| | | | | | |
|---|---|---|---|---|---|
| 4,071,236 | A | | 1/1978 | Oprean | |
| 4,074,904 | A | * | 2/1978 | Arcidiacono | 482/55 |
| 4,519,783 | A | * | 5/1985 | Burke, Jr. | 441/117 |
| 4,534,306 | A | * | 8/1985 | Rutten et al. | 114/311 |
| 5,011,137 | A | | 4/1991 | Murphy | |
| D329,220 | S | * | 9/1992 | Pauley et al. | D12/215 |
| 5,236,404 | A | | 8/1993 | MacLennan | |
| 5,244,393 | A | | 9/1993 | Perry | |
| 5,344,373 | A | * | 9/1994 | Greene | 482/55 |
| 5,391,080 | A | | 2/1995 | Bernacki et al. | |
| 5,394,817 | A | * | 3/1995 | Kaufman | 114/311 |
| 5,463,971 | A | * | 11/1995 | Abernethy | 114/311 |
| 5,472,394 | A | * | 12/1995 | Michaelson | 482/74 |
| 5,487,710 | A | | 1/1996 | Lavorgna et al. | |
| 5,501,451 | A | | 3/1996 | Slusarczyk | |
| 5,601,514 | A | | 2/1997 | Horn | |
| 5,779,509 | A | * | 7/1998 | Barman | 441/65 |
| 5,813,945 | A | * | 9/1998 | Bernacki | 482/5 |
| 5,816,982 | A | | 10/1998 | Croushore | |
| 5,846,167 | A | | 12/1998 | Liu et al. | |
| 6,135,046 | A | * | 10/2000 | Beech | 114/311 |
| 6,251,049 | B1 | | 6/2001 | Milton | |
| 6,634,993 | B1 | | 10/2003 | Morr | |
| 6,883,265 | B1 | * | 4/2005 | Jenssen | 43/9.1 |
| 7,104,932 | B1 | | 9/2006 | Brentlinger | |
| 7,442,151 | B1 | | 10/2008 | Berdegue | |
| 8,371,993 | B2 | * | 2/2013 | Brown et al. | 482/74 |
| 2004/0144014 | A1 | * | 7/2004 | Abel | 43/11 |
| 2004/0197754 | A1 | | 10/2004 | Coppelli | |
| 2005/0178311 | A1 | * | 8/2005 | Wittig | 114/311 |
| 2008/0161167 | A1 | | 7/2008 | Ottaviani | |
| 2009/0136775 | A1 | * | 5/2009 | Lanzi | 428/543 |
| 2010/0252590 | A1 | * | 10/2010 | Chan et al. | 224/191 |
| 2012/0015783 | A1 | * | 1/2012 | Brown et al. | 482/74 |
| 2012/0053021 | A1 | * | 3/2012 | Sherstnev et al. | 482/55 |
| 2012/0184417 | A1 | * | 7/2012 | Yablonowski et al. | 482/111 |

* cited by examiner

AQUATIC TRAINING DEVICE

FIELD OF THE INVENTION

This invention relates to a training device and in particular to an aquatic training device to provide resistance to movement of an athlete, for example a swimmer or a kayaker.

BACKGROUND TO THE INVENTION

In order to excel in swimming, apart from improving a swimmer's stroke technique, it is also important to increase the swimmer's body strength. One way to increase body strength is to perform weight training in a gym. However a disadvantage of this technique is that different muscles may be used than when swimming.

In order to overcome this disadvantage, training aids have been developed that provide resistance to the swimmer whilst swimming. Prior art patent documents disclose devices where a rope is connected between the swimmer and a piece of pool hardware, such as steps, to prevent the swimmer from moving and creating resistance to the swimmer. However a problem with such devices is that they can provide too much resistance and hinder the swimmer's natural stroke.

It is also known in the art to drag a bucket behind a swimmer to create resistance or drag. The bucket is attached to the swimmer by a length of rope. However, a disadvantage of these devices is that the bucket sinks to the bottom of the pool and scrapes along the bottom, possibly causing damage to the pool and providing uneven resistance to the swimmer. A variation of these devices allows the resistance of the bucket to be varied. A removable section in a bottom of the bucket may be replaced with different sized holes in order to vary the resistance. However, such devices are bulky and the resistance cannot be changed easily.

Still other prior art discloses parachute like devices that are towed behind the swimmer. The parachute has a hole in a canopy, and the resistance may be varied by varying the size of the hole, or by attaching a plurality of parachutes to the swimmer. However, here again a drawback is that the resistance cannot be changed easily, and in particular whilst the swimmer is in the pool. There is therefore a need for an improved aquatic training device.

The reference to any prior art in this specification is not, and should not be taken as, an acknowledgement or any form of suggestion that the prior art forms part of the common general knowledge.

OBJECT OF THE INVENTION

It is an object of the invention to overcome or alleviate one or more of the above disadvantages and/or to provide the consumer with a useful or commercial choice.

SUMMARY OF THE INVENTION

In one form, although it need not be the only or indeed the broadest form, the invention resides in an aquatic training device including:

a drag member including an inlet, an outlet and at least one side wall extending between the inlet and the outlet; and a link, for towing the drag member, coupled to the at least one side wall adjacent the inlet; wherein the drag member includes at least one drag inducer formed in or attached to the at least one side wall.

Preferably, the drag member defines a shape of a truncated cone.

Preferably an area of the inlet is larger than an area of the outlet.

Preferably, the at least one drag inducer is variable.

Optionally, the drag inducer includes a resealable slit formed in the at least one side wall. Preferably, the resealable slit may be varied between an open configuration and a closed configuration. Preferably, the resealable slit extends from an opening of the outlet to adjacent the inlet.

Preferably, the resealable slit is a zip.

Preferably, the at least one drag inducer includes a resealable aperture formed in the at least one side wall.

Preferably, the at least one drag inducer includes an expandable section formed in the at least one side wall, wherein the expandable section may be varied between a contracted configuration and an expanded configuration. Preferably the expandable section extends along the at least one side wall between the inlet and the outlet. Optionally, the expandable section is water permeable.

Preferably, the at least one drag inducer includes a channel formed on the at least one side wall. Preferably, the channel extends between the inlet and the outlet.

Optionally, the at least one drag inducer includes a tail section connected to a rim of the outlet. Preferably, the tail section is connected to the rim with a releasable fastener. Preferably, the tail section defines a truncated cone.

Optionally, the at least one drag member includes at least one fin. Preferably, the at least one fin is attached to the at least one side wall between the inlet and the outlet.

Optionally, the drag member includes at least one strengthening member formed on the at least one side wall. Preferably, the strengthening member extends from adjacent the inlet to adjacent the outlet. Preferably, the strengthening member includes an insert to aid buoyancy of the drag member.

Preferably, the link includes at least one floatation device.

Preferably, an end of the link is releasably connected to the drag member.

Preferably, the link includes a quick release connector. Preferably the quick release connector is attached to each end of the link. Preferably, the quick release connector is able to rotate through 360 degrees.

Preferably, the training device includes a harness releasably connected to an end of the link.

BRIEF DESCRIPTION OF THE DRAWINGS

To assist in understanding the invention and to enable a person skilled in the art to put the invention into practical effect, preferred embodiments of the invention will be described by way of example only with reference to the accompanying drawings, in which.

DETAILED DESCRIPTION OF THE INVENTION

Figure 1:
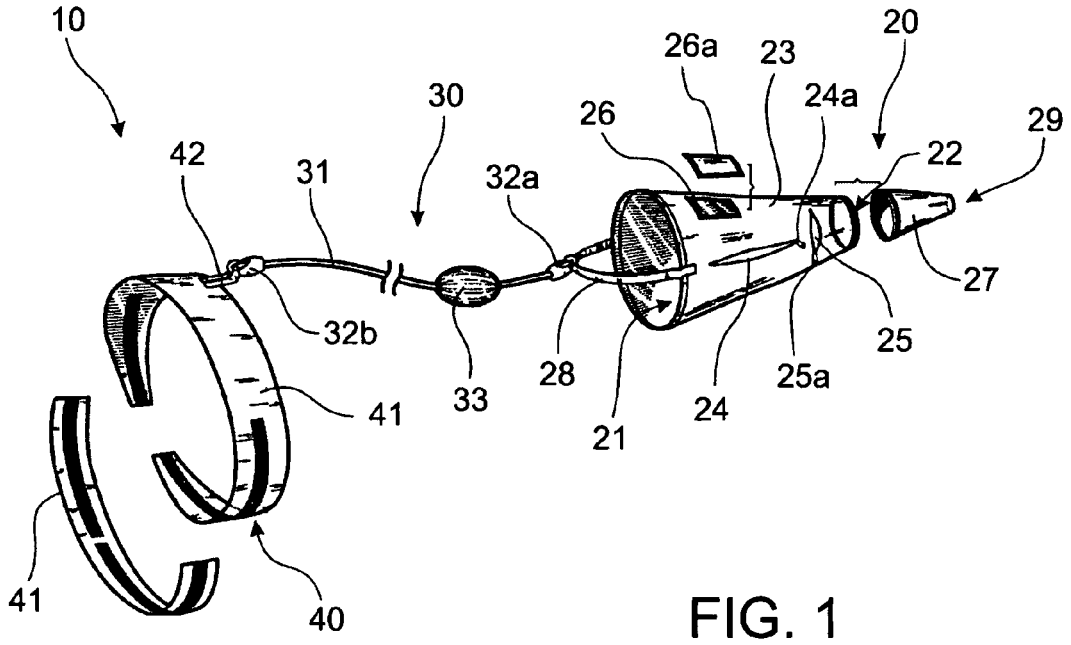
FIG. 1 shows a top perspective view of an aquatic training device according to a first embodiment of the present invention.

Embodiments of the present invention comprise an aquatic training device. Elements of the invention are illustrated in concise outline form in the drawings, showing only those specific details that are necessary to understanding the embodiments of the present invention, but so as not to clutter the disclosure with excessive detail that will be obvious to those of ordinary skill in the art in light of the present description.

In this patent specification, adjectives such as first and second, left and right, upper and lower, top and bottom, etc., are used solely to define one element or method step from another element or method step without necessarily requiring a specific relative position or sequence that is described by the adjectives. Words such as "comprises" or "includes" are not used to define an exclusive set of elements or method steps. Rather, such words merely define a minimum set of elements or method steps included in a particular embodiment of the present invention:

FIG. 1 shows a top perspective view of an aquatic resistance training device 10 according to an embodiment of the present invention. The training device 10 includes a drag member 20 coupled to a harness 40 with a link 30. The training device 10 creates drag when towed by a swimmer in water and allows the swimmer to increase his or her body strength with minimal impedance to the swimmer's natural stroke. A further advantage of the present invention is that the amount of drag produced by the drag member 20 may be easily varied.

The drag member 20 includes an inlet 21, an outlet 22 and a sidewall 23 extending between the inlet 21 and the outlet 22. The drag member 20 is hollow to allow the passage of water between the inlet 21 and the outlet 22. In one embodiment, the side wall 23 forms a truncated cone shape. However it should be appreciated that the side wall 23 may define other shapes, such as a pyramid, and may therefore have more than one side wall.

The drag member 20 is made of a material such as polyvinyl chloride (PVC) or nylon or any other suitable material that preferably does not degrade when immersed in chlorinated or saline water. Furthermore, the material may some resistance against damage from ultraviolet (UV) radiation or sunlight. Additionally, the material may be impervious or semi-impervious to the passage of water, and may be semi rigid or have strengthening members in order to keep its shape.

The drag member 20 also includes drag inducers in the form of slits 24, 25, a resealable aperture 26 and a tail section 27 formed in or attached to the side wall 23. The amount of drag is varied by adjusting the drag inducers thus changing the amount of water that passes through the drag inducers. Increasing the amount of water flow through or over the drag inducers generally reduces the amount of drag and hence the amount of resistance experienced by the swimmer. Reducing or impeding water flow through the drag inducers increases the amount of drag and hence the amount of resistance experienced by the swimmer.

The slits 24, 25 may be in the form of a longitudinal slit and a transverse slit. A length of the slits 24, 25 may be varied by adjusting fasteners 24*a*, 25*a*. By varying the length of the slits 24, 25 the amount of water passing through each of the slits 24, 25 varies and hence the amount of drag induced also varies. In one embodiment, each fastener 24*a*, 25*a* is a zip. However it should be appreciated that the fastener may be any suitable fastener such as a hook and loop fastener or buttons. Preferably, additional slits (not shown) are positioned on opposing sides of the side wall 23 opposite the slits 24, 25 to add stability as the drag member 20 is pulled through the water. Although the slits 24, 25 defining the drag inducers are shown as extending longitudinally and transversely with respect to an axis extending between the inlet 21 and the outlet 22, it should be appreciated that the slits 24, 25 may extend at any angle.

The resealable aperture 26 includes a patch 26*a* and may be sealed by placing the patch 26*a* over the resealable aperture 26. The patch 26*a* is secured to the side wall 23 adjacent the resealable aperture 26 using a hook and loop fastener. Alternatively, the patch 26*a* is secured to the side wall 23 adjacent the resealable aperture 26 using a zip or any other suitable fastener. The amount of drag and hence resistance experienced by the swimmer may be increased by sealing the resealable aperture 26 with the patch 26*a*.

The tail section 27 is an extension of the truncated cone shape of the side walls 23. A rim of the inlet of the tail section 27 is releasably attached to a rim of the outlet 22 using a releasable fastener such as a hook and loop fastener or a zip. The tail section 27 reduces the size of an outlet 29 of the tail section and increases the amount of drag and hence the amount of resistance experienced by the swimmer.

The drag member 20 also includes a strap 28 attached to opposing edges of the side wall 23, adjacent the inlet 21. The strap 28 allows the link 30 to be connected to the drag member 20.

The link 30 includes a line 31 made from rope or any suitable material which is preferably resistant to saline and/or chlorinated water depending on the application. At each end of the line 31 is a quick release connector 32*a*, 32*b*. Quick release connector 32*a* releasably connects the link 30 to the strap 28 of the drag member 20 and quick release connector 32*b* releasably connects the link 30 to the harness 40.

Also shown is a float 33 positioned on the line 31 to aid buoyancy of the line 31. Although a single float 33 is shown it should be appreciated that any number floats 33 may be positioned on the line 31.

The harness 40 includes a belt 41 to wrap around a waist of the swimmer. The belt 41 includes a hook and loop fastening system to secure the harness 40 to the swimmer. Although the belt 41 is shown as being a two piece arrangement, a person skilled in the art will appreciate that the belt 41 may be formed from a single piece of material. The harness 40 also includes a loop 42 for accepting quick release connector 32*b*.

Figure 2:
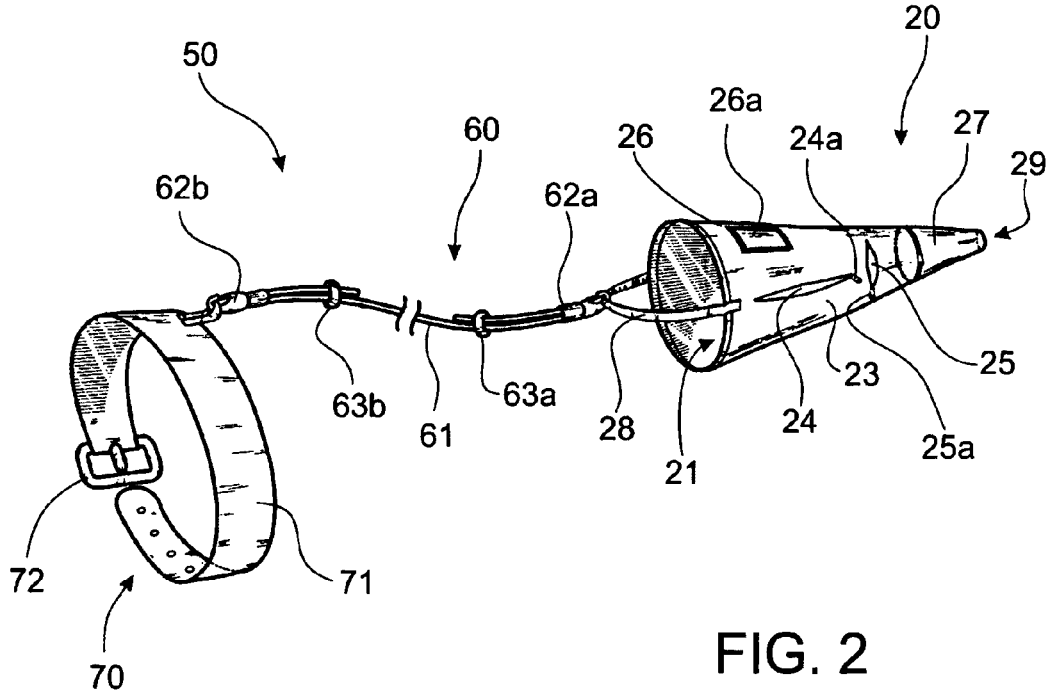
FIG. 2 shows a top perspective view of an aquatic training device according to a second embodiment of the present invention.

FIG. 2 shows a top perspective view of a training device 50 according to a second embodiment of the present invention. The training device 50 includes the drag member 20 of FIG. 1 with the resealable aperture 26 covered by the patch 26*a* and the tail section 27 connected to the rim of the outlet 22. The effect of covering the resealable aperture 26 of and adding the tail section 27 is to increase the amount of drag.

FIG. 2 also shows alternative embodiments of the link 30 and the harness 40 of FIG. 1. Link 60 is identical to the link 30, with the exception that line 61 is adjustable in length. In this embodiment, the line 61 of the link 60 is looped through a respective quick release connector 62*a*, 62*b* in order to adjust a length of the line 61. Clips 63*a*, 63*b* allow any excess in the line 61 to be secured to the line 61.

Harness 70 is identical to the harness 40 of FIG. 1 except that belt 71 is of unitary construction. Furthermore, the belt 71 is fastened using a buckle 72 instead of hook and loop fasteners.

Figure 3A:
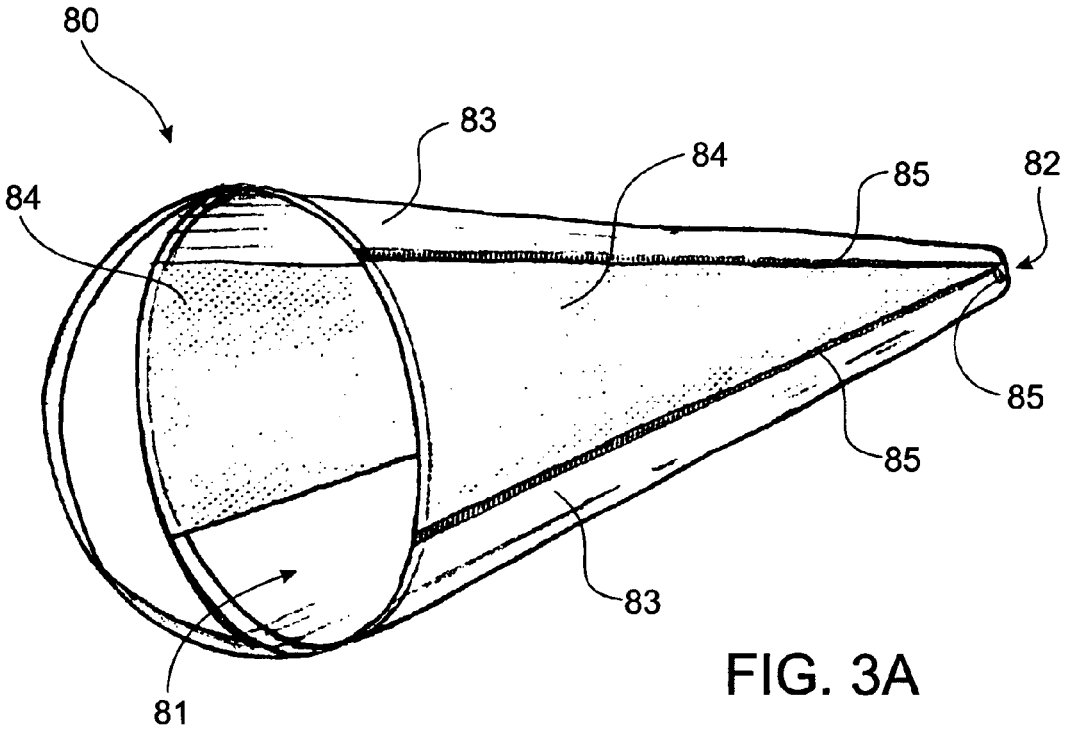
FIG. 3A shows a top perspective view of an aquatic training device according to a third embodiment of the present invention.
Figure 3B:
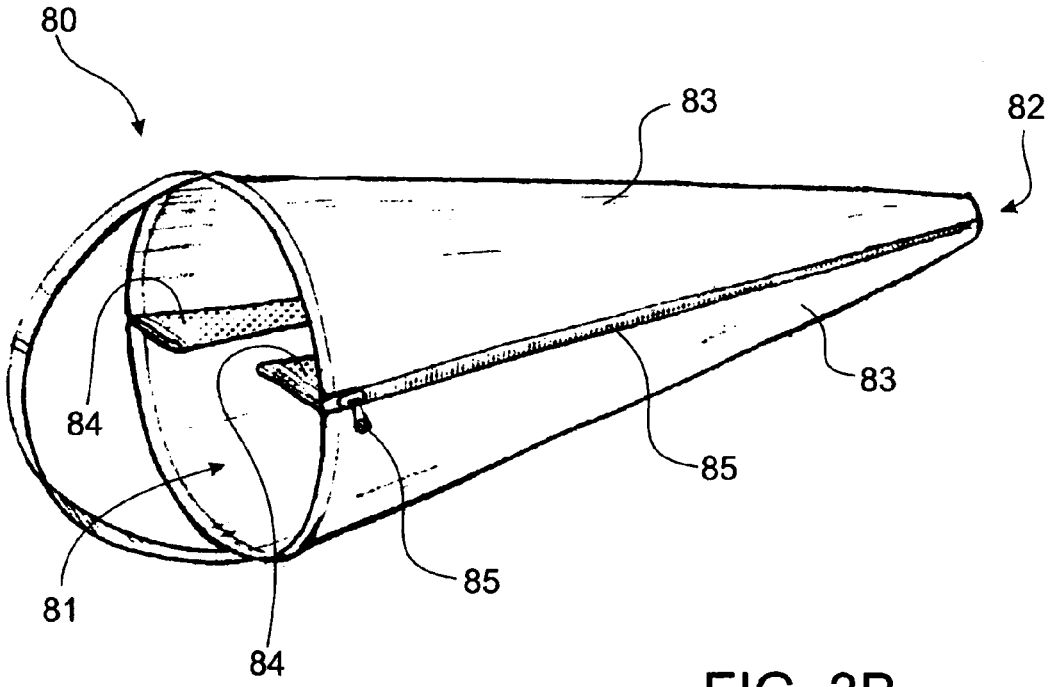
FIG. 3B shows a top perspective view of the aquatic training device of FIG. 3A with drag inducers in a contracted configuration.

FIGS. 3A and 3B show top perspective views of a drag member 80 according to a third embodiment of the present invention. Similar to the embodiment of FIGS. 1 and 2, the drag member 80 includes an inlet 81, an outlet 82 and side walls 83 extending between the inlet 81 and the outlet 82.

In this embodiment, the drag inducer is in the form of expandable sections 84, where the expandable sections 84 are formed in opposing surfaces of the side walls 83. However it should be appreciated that one or more expandable sections 84 may be formed. FIG. 3A shows the expandable sections 84 in an expanded configuration, and FIG. 3B show the expandable sections 84 in a contracted configuration.

The expandable sections 84 allow the size or area of the inlet 81 to be varied, and thus vary the amount of fluid flowing through the drag member 80. Each expandable section 84 may be triangular in shape, with a base of the triangle positioned adjacent the inlet 81 and a tip of the triangle extending towards the outlet 82. However it should be appreciated that the expandable sections 84 may be any suitable shape that tapers from the inlet 81 to the outlet 82.

Furthermore, the expandable sections 84 may be shaped such that an area of the inlet 81 and the outlet 82 are varied.

In order to reduce an area of the inlet 81, an expandable section 84 is contracted by tucking the expandable section 84 inside the drag member 80 and securing edges of the side wall 83 on either side of the expandable section 84 with a fastener 85. In one embodiment, the fastener is a zipper, however it should be appreciated that the fastener may alternatively be hook and loop fastener. By adjusting a position of the fastener 85 between the inlet 81 and the outlet 82, the area of the inlet 81 may be varied.

As shown in FIGS. 3A and 3B the expandable sections 84 may be made of a mesh material. However it should be appreciated that the expandable sections 84 may be non-permeable. As would be understood by a person skilled in the art, the density of the mesh may be selected to produce a desired amount of drag.

Figure 4A:
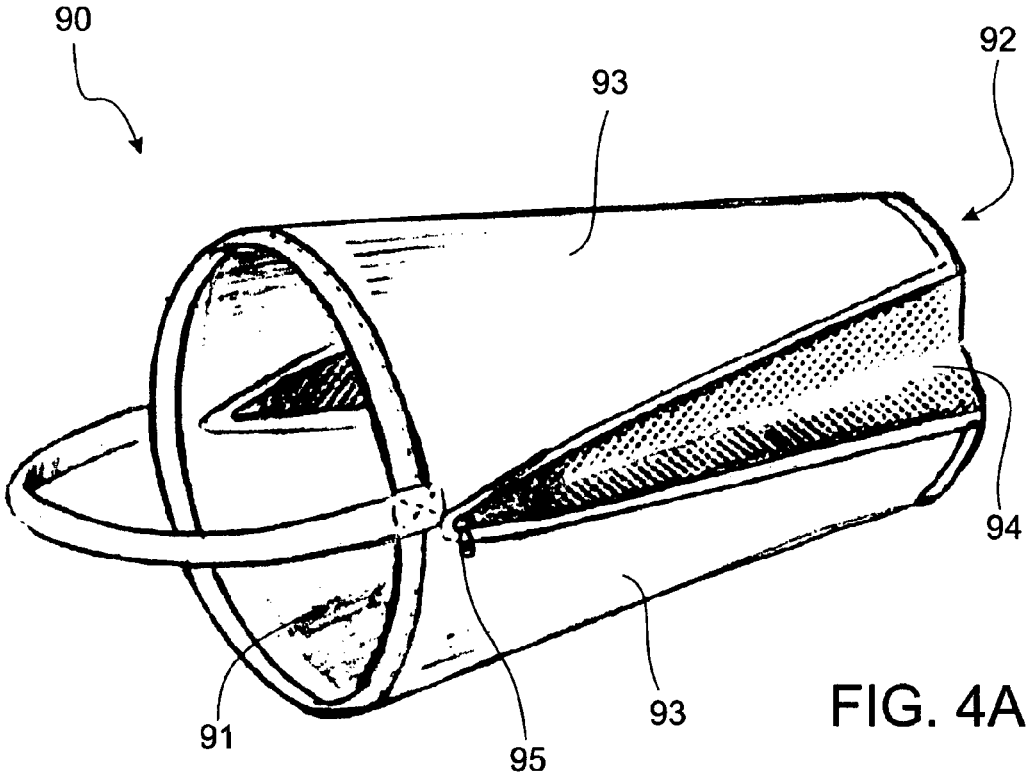
FIG. 4A shows a top perspective view of an aquatic training device according to a fourth embodiment of the present invention.
Figure 4B:
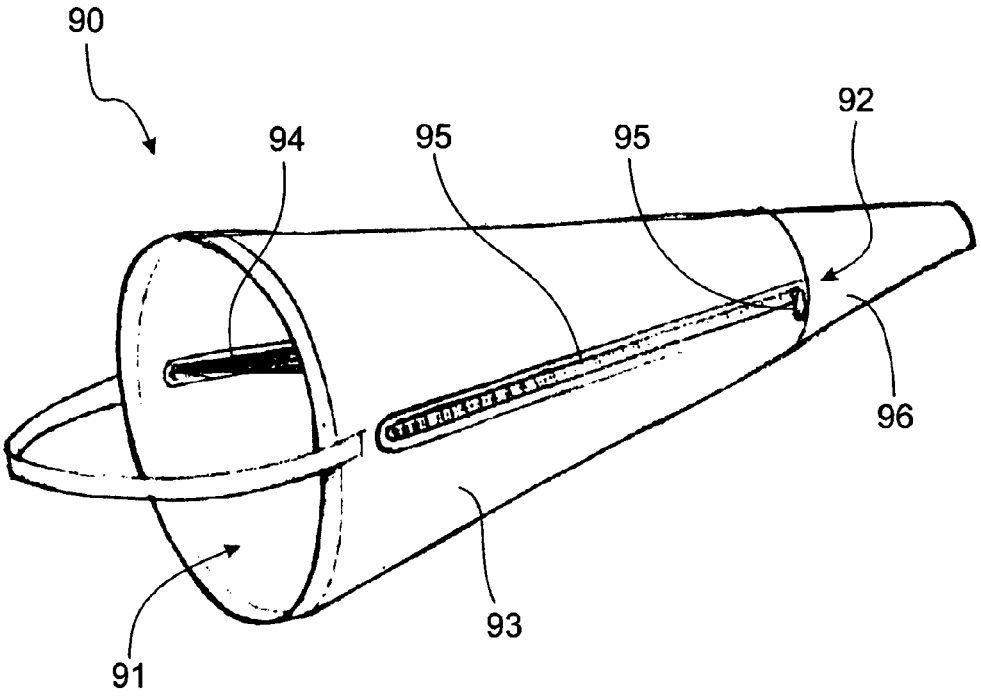
FIG. 4B shows a top perspective view of the aquatic training device of FIG. 4A with drag inducers in a contracted configuration.

FIGS. 4A and 4B show top perspective views of a drag member 90 in expanded and collapsed configurations respectively, according to a fourth embodiment of the present invention. Similar to the embodiments of FIGS. 3A and 3B, the drag member 90 includes an inlet 91, an outlet 92 and side walls 93 extending between the inlet 91 and the outlet 92.

This embodiment is similar to the embodiment of FIGS. 3A and 3B with the exception that the size of the outlet 92, rather than the inlet 91, is adjusted by expandable sections 94 and fastener 95. Similar to the embodiment of FIGS. 1 and 2, the drag member 90 includes a tail section 96 connected to a rim of the outlet 92 in order to increase the amount of resistance or drag.

Figure 5A:
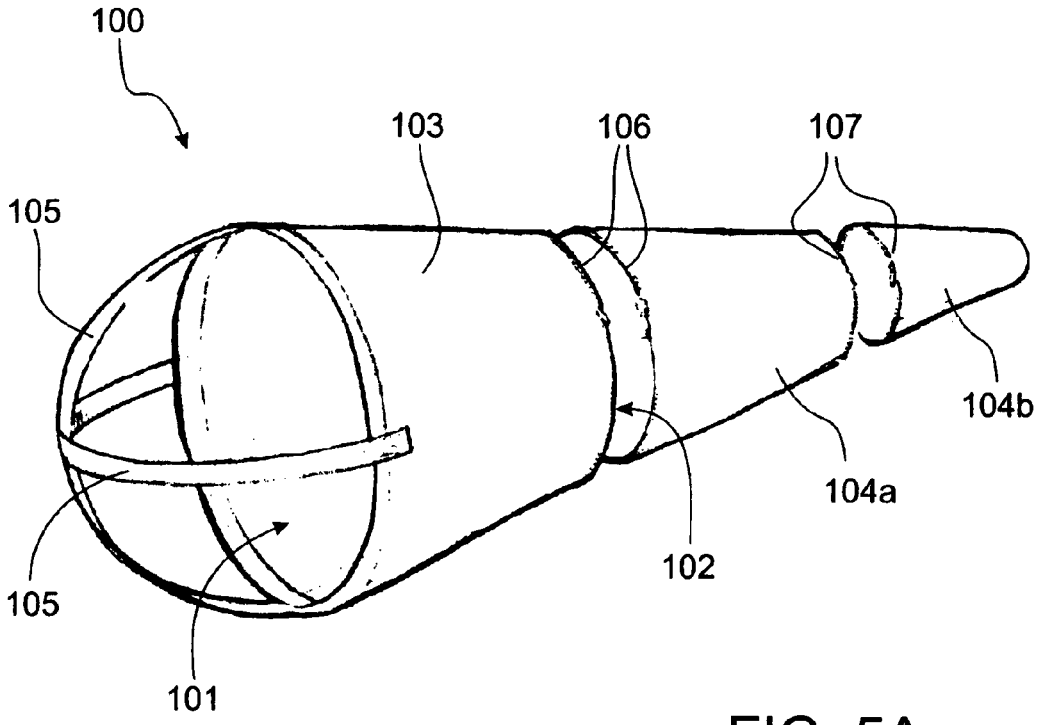
FIG. 5A shows a top perspective view of an aquatic training device according to a fifth embodiment of the present invention.
Figure 5B:
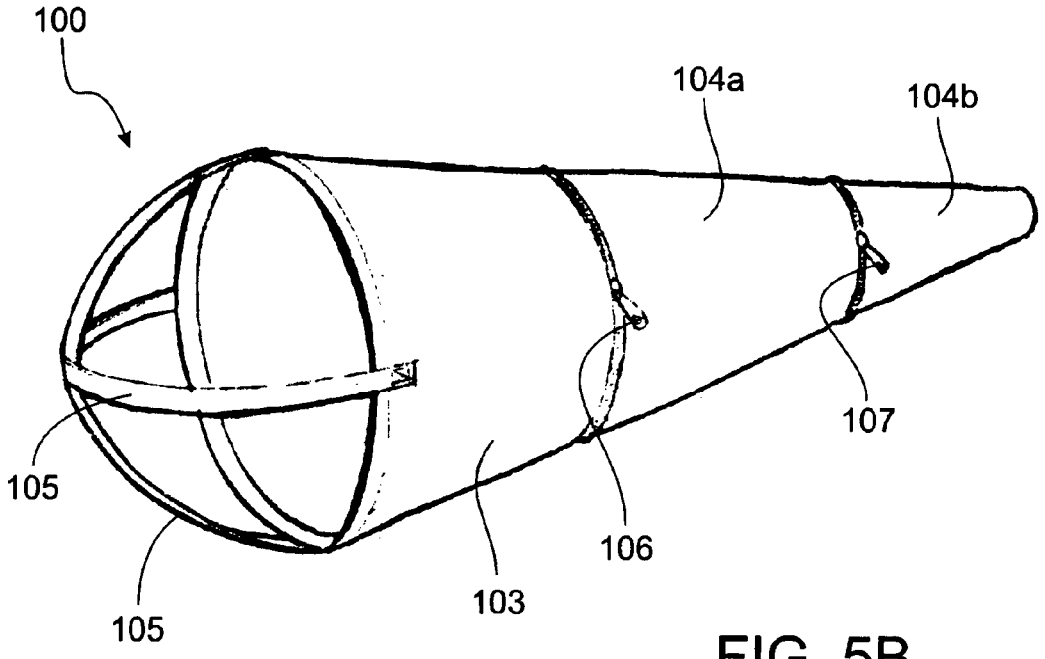
FIG. 5B shows a top perspective view of the aquatic training device of FIG. 5A with tail sections attached to an outlet.

FIGS. 5A and 5B show perspective views of a drag member 100 according to a fifth embodiment of the present invention. Similar to the embodiment of FIGS. 1 to 2, the drag member 100 includes an inlet 101, an outlet 102 and side walls 103 extending between the inlet 101 and the outlet 102.

In this embodiment, the drag inducer includes two tail sections 104*a*, 104*b*. A rim of an inlet of the first tail section 104*a* is connected to a rim of the outlet 102 using a suitable fastener 106 such as a zip. If more resistance or drag is required, a rim of an inlet of the second tail section 104*b* is connected to a rim of an outlet of the first tail section 104*a* with fastener 107.

Furthermore, the drag member 100 also includes two straps 105 connected at substantially right angles for coupling the link (not shown) rather than the single strap of FIGS. 1 to 4. However it should be appreciated that any suitable connector may be used to couple the link 30 of FIGS. 1 and 2 to the drag member 100.

Figure 6A:
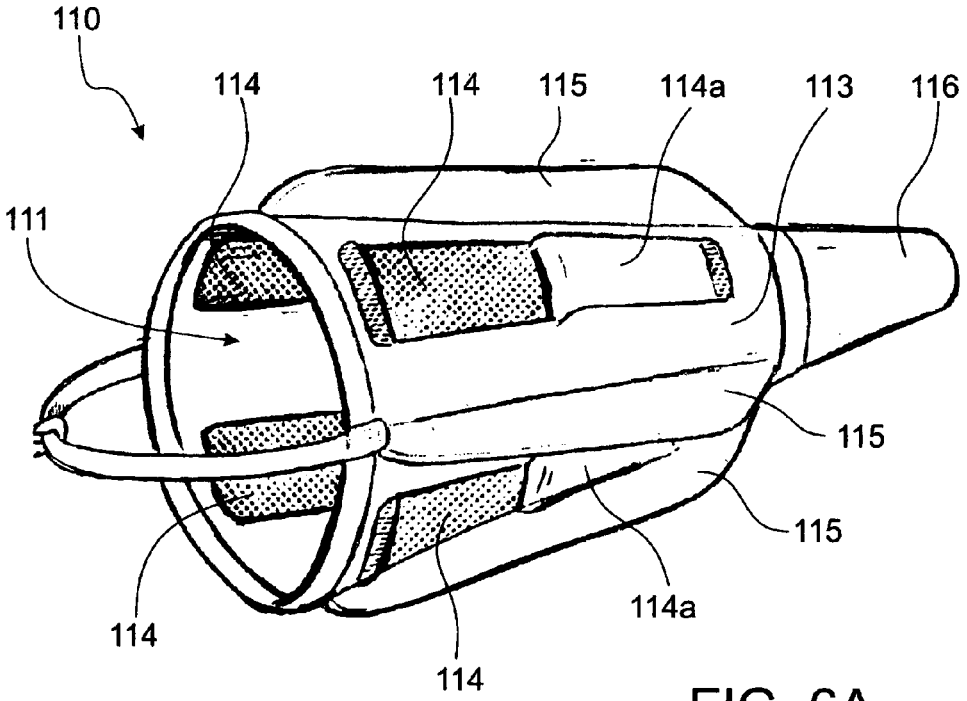
FIG. 6A shows a top perspective view of an aquatic training device according to a sixth embodiment of the present invention.
Figure 6B:
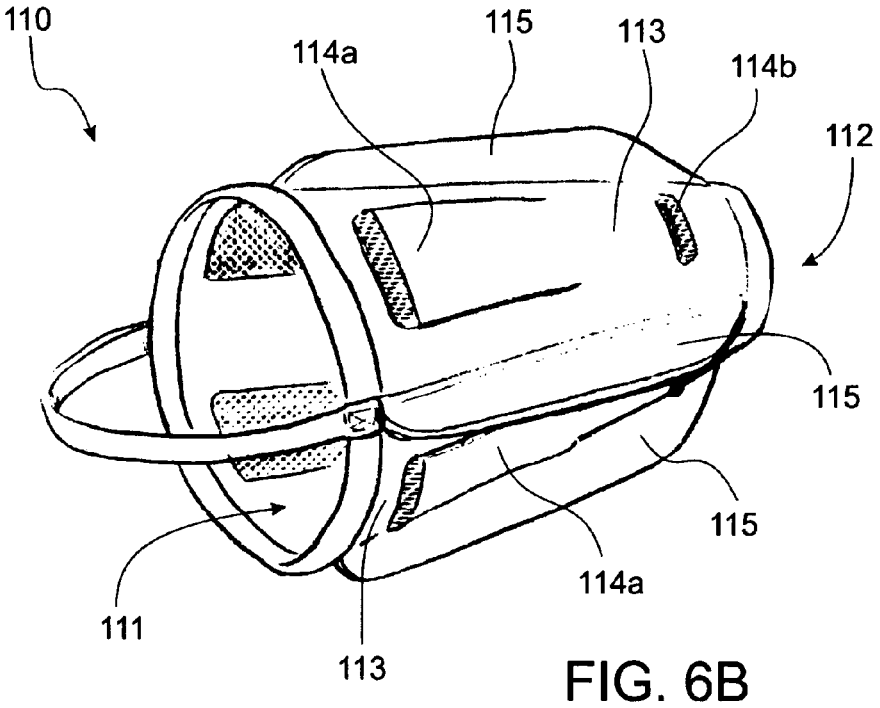
FIG. 6B shows a top perspective view of the aquatic training device of FIG. 5A with drag inducers in a closed configuration.

FIGS. 6A and 6B show top perspective views of a drag member 110 in open and closed configurations respectively according to a sixth embodiment of the present invention. Similar to the embodiment of FIGS. 1 to 2, the drag member 110 includes an inlet 111, an outlet 112 and side walls 113 extending between the inlet 111 and the outlet 112.

In this embodiment, the drag inducers are in the form of apertures 114. The apertures 114 are similar to the embodiment of FIGS. 1 and 2 with the exception that each of the apertures 114 include a mesh cover. It should be appreciated however that the apertures 114 may not have the mesh cover. A further point of difference to FIGS. 1 and 2 is that patches 114*a* are attached along an edge to the side wall 113 to allow each patch 114*a* to fold back towards the outlet 112. It should be appreciated that the patches 114*a* may fold in any suitable direction.

The apertures 114 are closed by placing a respective patch 114*a* over a respective aperture 114. The apertures 114 are opened by folding back the patch 114*a*. The patch 114*a* is held in an open position with a fastener 114*b* in the form of a hook and loop fastener. However it should be appreciated that any suitable fastener such as a button or press stud may be used.

In addition, the drag member 110 includes a tail section 116 that may be secured to a rim of the outlet 112 using a zip, hook and loop fasteners or any other suitable fastening system. As previously explained, the tail section 116 may be connected to increase the amount of drag and hence resistance experienced by the swimmer.

Additionally, in this embodiment, the drag member 110 includes a plurality of fins 115. The fins 115 extend along the side wall 113 from the inlet 111 to the outlet 112 to aid the stability of the drag member 110. Although three fins are shown, it should be appreciated that any number of fins may be used.

Figure 7A:
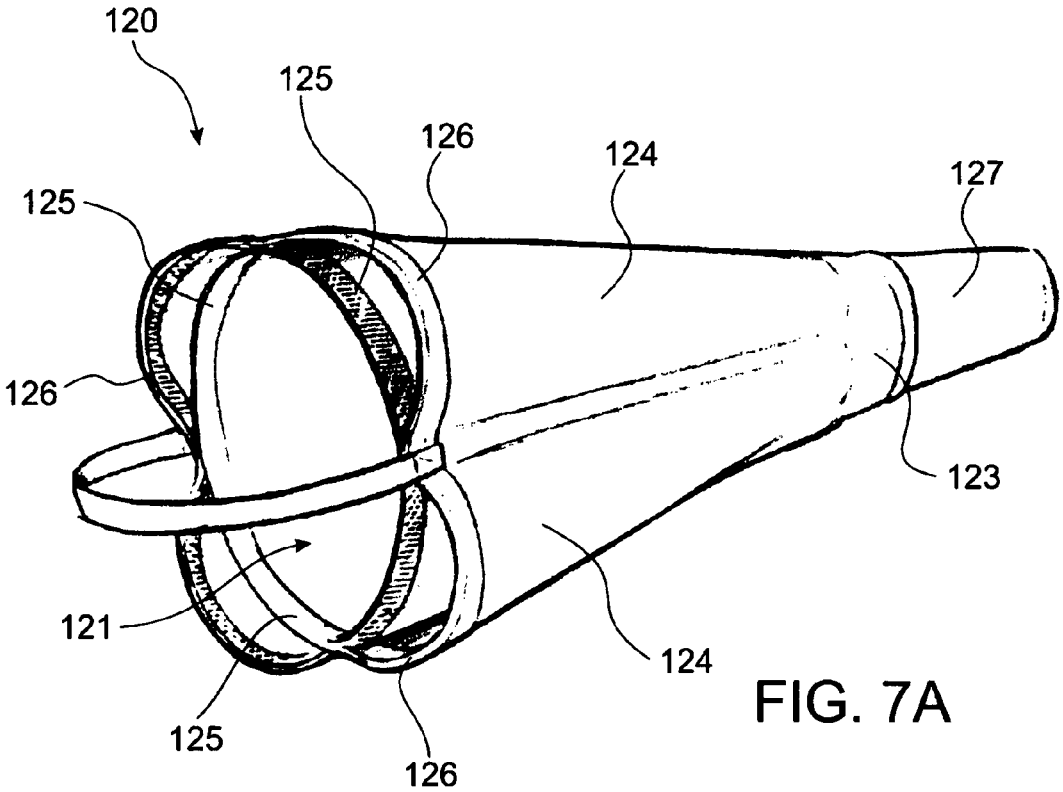
FIG. 7A shows a top perspective view of an aquatic training device according to a seventh embodiment of the present invention.
Figure 7B:
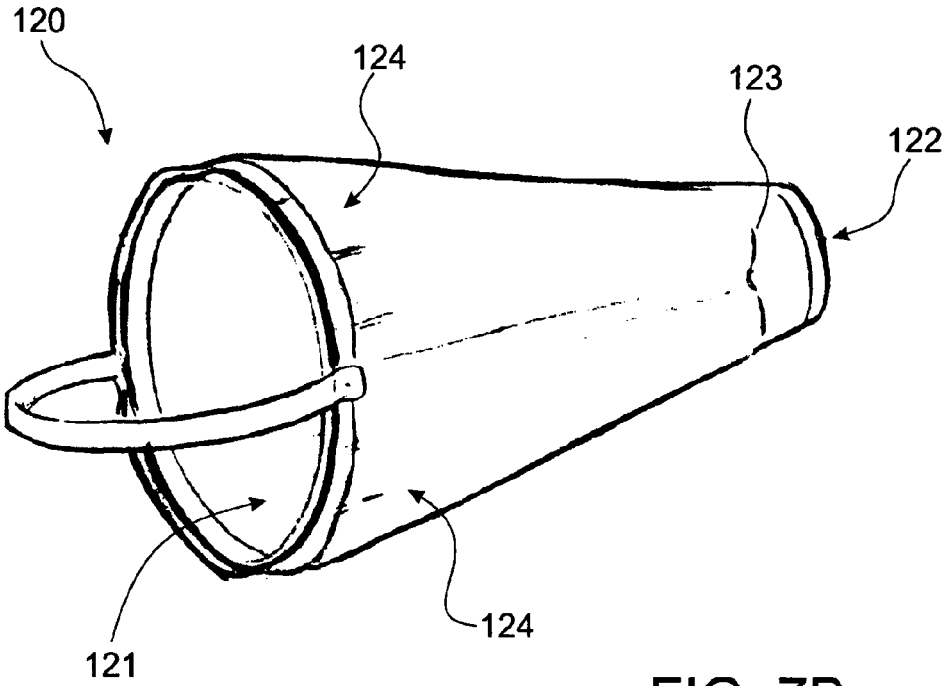
FIG. 7B shows a top perspective view of the aquatic training device of FIG. 7A with drag inducers in a closed configuration.

FIGS. 7A and 7B show top perspective views of a drag member 120 in open and closed configurations respectively according to a seventh embodiment of the present invention. Similarly to the embodiment of FIGS. 1 to 2, the drag member 120 includes an inlet 121, an outlet 122 and side walls 123 extending between the inlet 121 and the outlet 122.

In this embodiment, the drag inducer is in the form of channels 124 formed on the surface of the side walls 123. The channels 124 extend from adjacent the inlet to adjacent the outlet. When open, as shown in FIG. 7A, the channels 124 direct water through them and induce extra drag. In order to close the channels 124 and reduce the amount of drag, as shown in FIG. 7B, a lip 125 adjacent the inlet 121 is secured to a lip 126 of the channel 124 using a hook and loop fastener. Again it should be appreciated that any suitable fastener may be used. Furthermore, a tail section 127 may additionally be connected to a rim of the outlet 122.

Figure 8A:
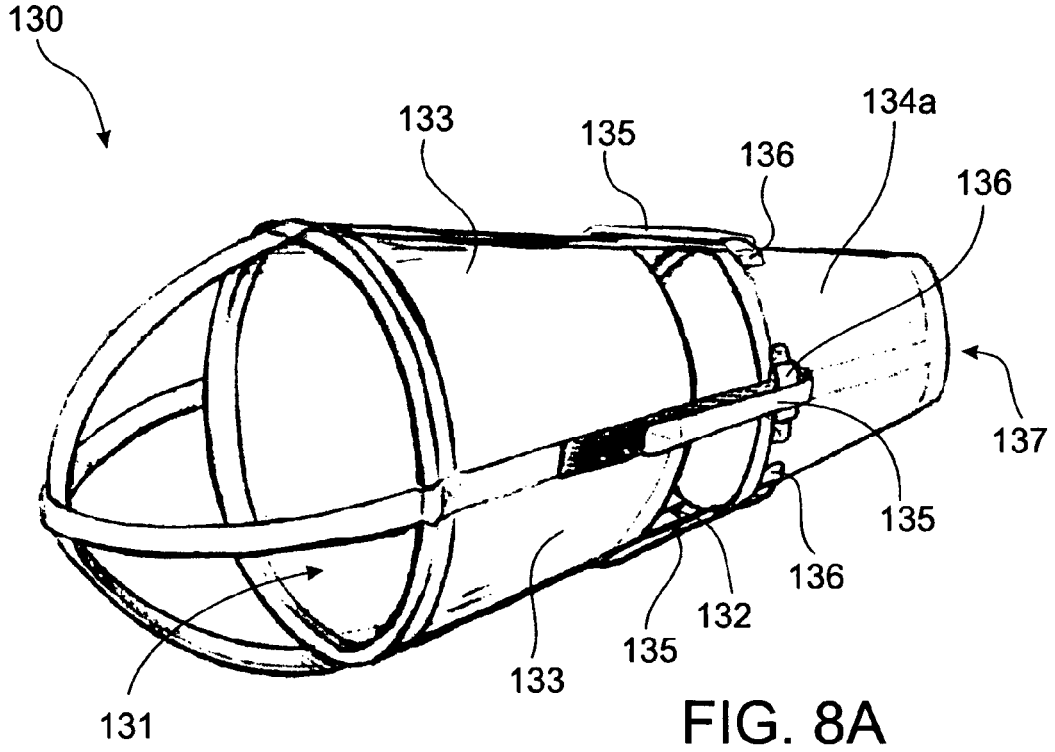
FIG. 8A shows a top perspective view of an aquatic training device according to an eighth embodiment of the present invention.
Figure 8B:
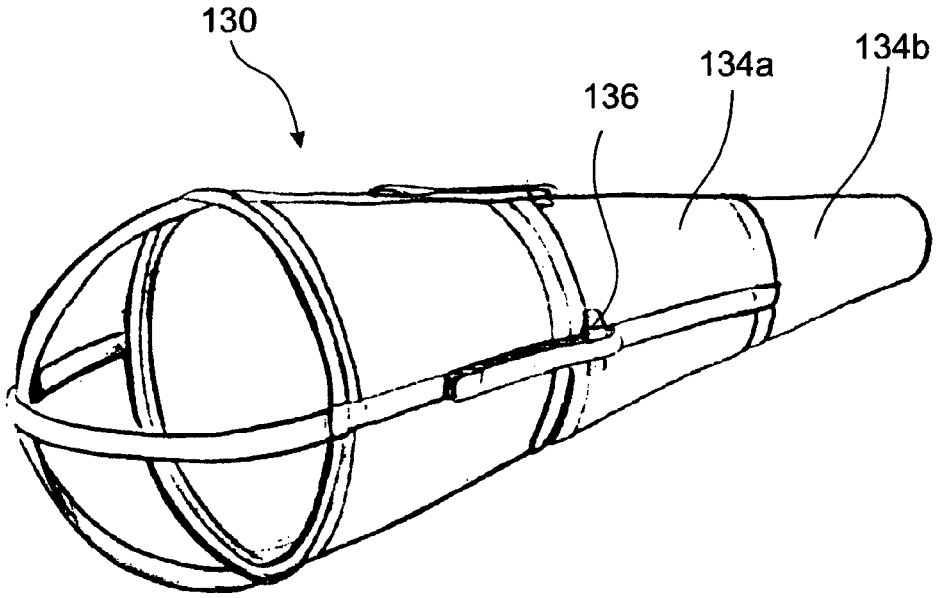
FIG. 8B shows a top perspective view of the aquatic training device of FIG. 8A with drag inducers in a closed configuration.

FIGS. 8A and 8B show top perspective views of a drag member 130 in open and closed configurations respectively according to an eighth embodiment of the present invention. Similarly to the embodiment of FIGS. 1 and 2, the drag member 130 includes an inlet 131, an outlet 132 and side walls 133 extending between the inlet 131 and the outlet 132.

In this embodiment, and similarly to the embodiment shown in FIGS. 5A and 5B, the drag inducer is in the form of a first tail section 134*a*. However in this embodiment the first tail section 134*a* is connected to a rim of the outlet 132 using fasteners in the form of straps 135. The straps 135 are passed through a loop 136 positioned on the first tail section 134*a* and fastened back on to the strap using a hook and loop fastener or any other suitable fastener. A gap between the outlet 132 and the first tail section 134*a* may be adjusted by positioning the straps 135. Having a larger gap allows more water to pass through the drag member 130 and reduces the amount of drag.

A connection between the outlet 132 and the first tail section 134*a* may be improved using hook and loop fasteners positioned around the outlet 132 and an inlet to the first tail section 134*a*. Furthermore, additional tail sections 134*b* may be connected to a rim of an outlet 137 of the first tail section 134*a*.

Figure 9:
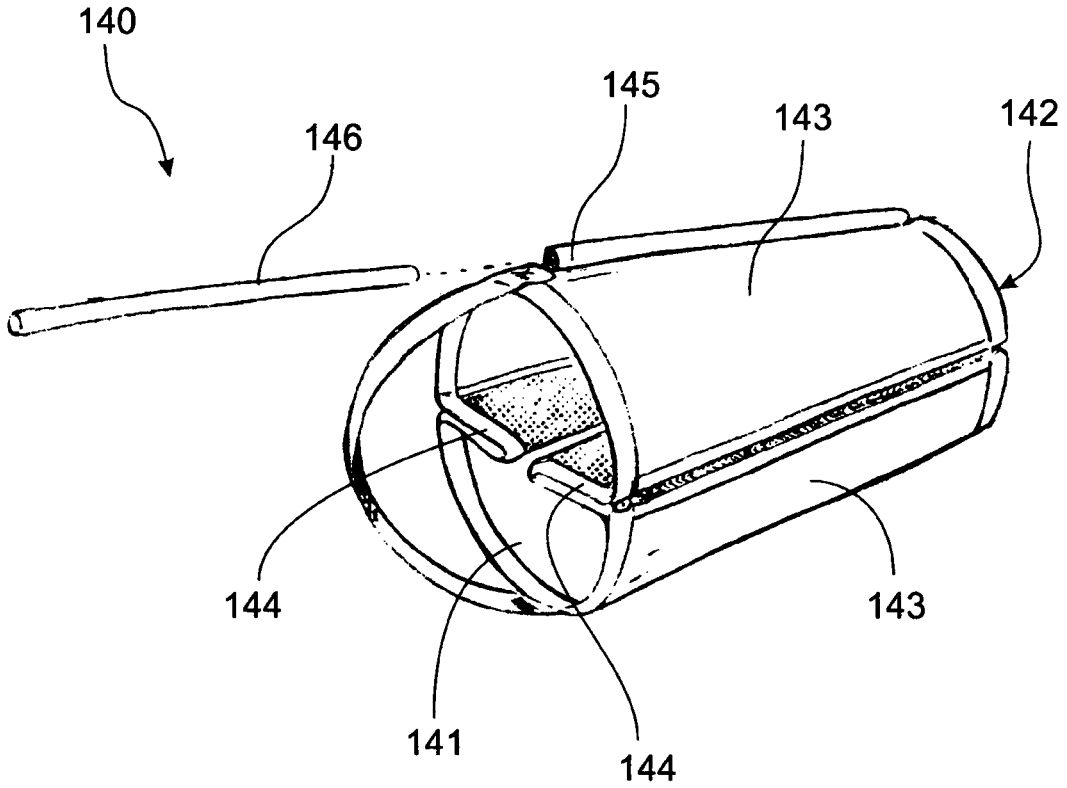
FIG. 9 shows a top perspective view of an aquatic training device according to a ninth embodiment of the present invention.

FIG. 9A shows a top perspective view of a drag member 140 according to a ninth embodiment of the present invention. Similar to the embodiment of FIGS. 3A and 3B, the drag member 140 includes an inlet 141, an outlet 142, side walls 143 extending between the inlet 141 and the outlet 142 and expandable sections 144.

In this embodiment, a strengthening member 145 extends from adjacent the inlet 141 along the side wall 143 to adjacent the outlet 142. The strengthening member 145 is tubular in construction and is formed from fabric. Furthermore and in order to provide extra buoyancy, if required, an insert 146, made of foam for example, may be placed into the strengthening member 145. Furthermore, the insert 146 may provide extra strengthening.

Figure 10A:
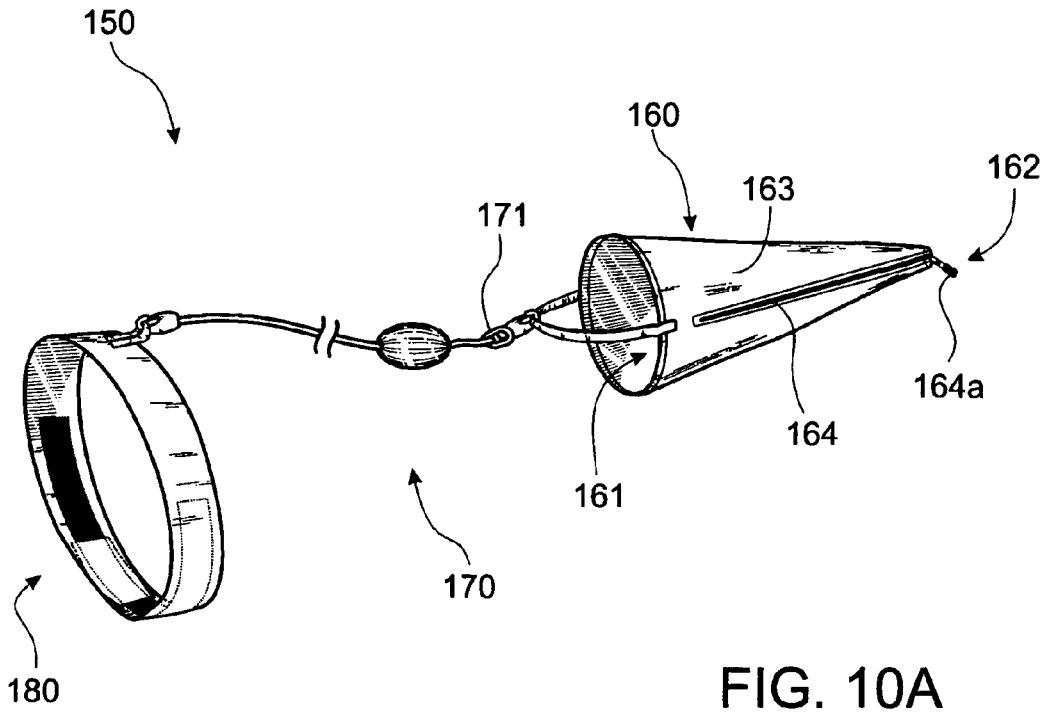
FIG. 10A shows a top perspective view of an aquatic training device in a closed configuration according to a tenth embodiment of the present invention.
Figure 10B:
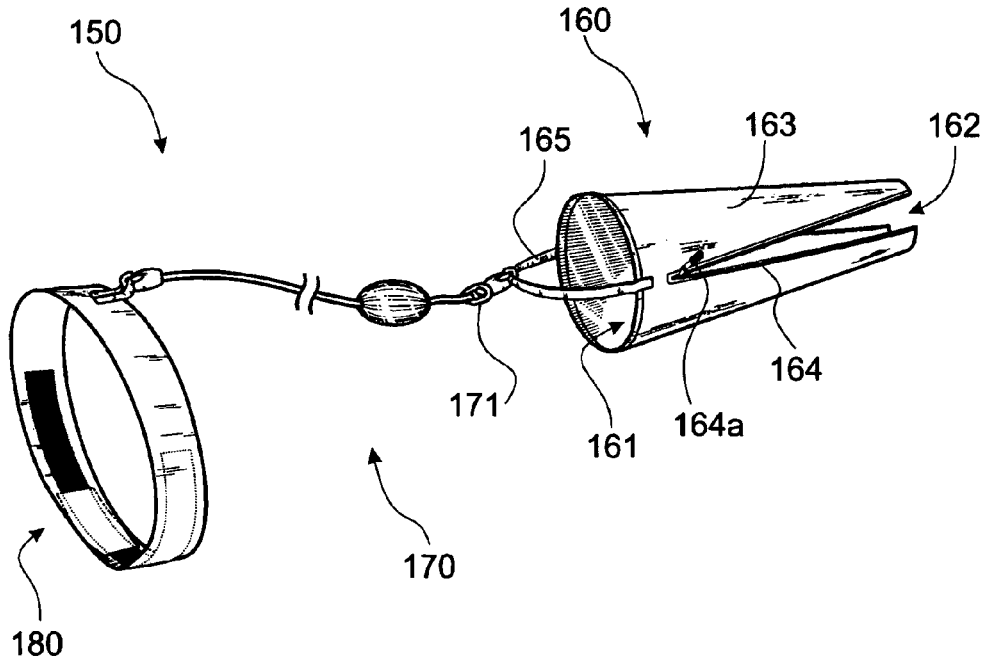
FIG. 10B shows a top perspective view of the aquatic training device of FIG. 10A in an open configuration.

FIGS. 10A and 10B show top perspective views of an aquatic training device 150 in closed and open configurations respectively according to a tenth embodiment of the present invention. The aquatic training device 150 includes a drag member 160, a link 170 and a harness 180.

Similar to previous embodiments, the drag member 160 includes an inlet 161, an outlet 162, side walls 163 extending between the inlet 161 and the outlet 162, and drag inducers.

In this embodiment, the drag inducers are in the form of slits 164 and are similar to the slit 24 of FIG. 1 except each slit 164 extends to an end of the side wall 163 from an opening of the outlet 162 to adjacent the inlet 161. The slits 164 may be varied by adjusting fasteners 164*a*, such as a zip or a hook and loop arrangement. The fasteners 164*a* may be adjusted anywhere between a closed configuration, at an opening of the outlet 161, to an open configuration adjacent the inlet 161. As the fasteners 164*a* are opened from the outlet 162 towards the inlet 161, the side walls 163 separate thus increasing an area of the outlet 162 and decreasing the amount of drag.

The side walls 163 may also include markers (not shown) for positioning the fasteners 164 at a particular position in order to set a desired amount of drag.

Another difference to previous embodiments is that quick release connector 165 may swivel through 360 degrees in order to allow the drag member 160 to rotate as the drag member 160 is pulled through the water. The benefit of allowing the drag member 160 to rotate is that the drag member 160 does not tug as it is pulled through the water.

According to the various embodiments of the present invention described above, in use a swimmer secures a harness around his or her waist and a drag member is coupled to the harness via the link. When the swimmer swims, the drag member is towed behind the swimmer. The drag member produces drag and the swimmer experiences resistance in order to increase his or her body strength. The swimmer may vary the amount of drag and hence the amount of resistance by adjusting one or more of the drag inducers located in or on the side walls of the drag member.

Advantages of the present invention over the prior art include the compactness of the present invention, which enables it to be easily stowed. Secondly, the amount of drag or resistance may be varied quickly and easily. Thirdly the training devices of the present invention do not damage the bottom of a pool. Furthermore, a swimmer is able to perform his or her normal stoke without being impeded by the training device.

It should be appreciated that although the present invention has been described in relation to a training device for use in swimming, it should be appreciated that the present invention may be applied to other sports. In particular, the present invention may be used for the sport of kayaking or canoeing. In this case, the line is connected to the end of the kayak and an athlete is able to paddle with some resistance depending on a setting of drag inducers positioned on the drag member. Furthermore, it should be appreciated that the training device may include any selection of any one or more of the drag inducer embodiments previously described.

The above description of various embodiments of the present invention is provided for purposes of description to one of ordinary skill in the related art. It is not intended to be exhaustive or to limit the invention to a single disclosed embodiment. As mentioned above, numerous alternatives and variations to the present invention will be apparent to those skilled in the art of the above teaching. Accordingly, while some alternative embodiments have been discussed specifically, other embodiments will be apparent or relatively easily developed by those of ordinary skill in the art. Accordingly, this patent specification is intended to embrace all alternatives, modifications and variations of the present invention that have been discussed herein, and other embodiments that fall within the spirit and scope of the above described invention.

Limitations in any patent claims should be interpreted broadly based on the language used in the claims, and such limitations should not be limited to specific examples described herein. In this specification, the terminology "present invention" is used as a reference to one or more aspects within the present disclosure. The terminology "present invention" should not be improperly interpreted as an identification of critical elements, should not be improperly interpreted as applying to all aspects and embodiments, and should not be improperly interpreted as limiting the scope of any patent claims.

The invention claimed is:

1. An aquatic training device including:

a drag member including an inlet, an outlet and at least one side wall extending between the inlet and the outlet, wherein a cross-sectional area of the inlet is larger than a cross-sectional area of the outlet; and a link, for towing the drag member, coupled to the at least one side wall adjacent the inlet;

wherein the drag member includes a resealable slit formed in the at least one side wall, the resealable slit extending along the at least one side wall and into at least one of the inlet and the outlet, the resealable slit configured to vary an amount of drag produced by the drag member when the drag member is towed through water by a swimmer by increasing or decreasing a cross-sectional area of at least one of the inlet and the outlet.

2. The aquatic training device of claim 1 wherein the drag member defines a shape of a truncated cone.

3. The aquatic training device of claim 1 wherein the resealable slit is variable between an open configuration and a closed configuration.

4. The training device of claim 1 wherein the slit extends along a length of the drag member between the outlet and the inlet.

5. The training device of claim 1 wherein the slit is resealable by a zip.

6. The training device of claim 1 wherein the slit defines a resealable aperture formed in the at least one side wall.

7. The training device of claim 1 further including an expandable section formed in the at least one side wall, the expandable section configured to increase or decrease a cross-sectional area of at least one of the inlet and the outlet.

8. The training device of claim 7 wherein the expandable section is varied between a contracted configuration and an expanded configuration by opening and closing the resealable slit.

9. The training device of claim 7 wherein the expandable section extends along the at least one side wall between the inlet and the outlet.

10. The training device of claim 7 wherein the expandable section is water permeable.

11. The training device of claim 1 further including at least one tail section connected to a rim of the outlet.

12. The training device of claim 1 wherein the link includes at least one floatation device.

13. The training device of claim 1 wherein the link is releasably connected to the drag member.

14. The training device of claim 13 wherein the link includes a quick release connector.

15. The training device of claim 14 wherein the quick release connector is able to rotate through 360 degrees.

16. The training device of claim 1 wherein the at least one side wall forms a tube extending between the inlet and the outlet.

17. The training device of claim 1 wherein at least one resealable slit extends longitudinally between the outlet and the inlet.

18. The training device of claim 1 wherein the drag member includes two or more resealable slits such that a first resealable slit and a second resealable slit are positioned on opposite sides of the side wall.

19. The training device of claim 1, wherein the side wall comprises a tapering from the inlet to the outlet, and wherein the resealable slit is configured to vary the amount of drag produced by the drag member by increasing or decreasing the tapering of the side wall from the inlet to the outlet.

20. The training device of claim 1, wherein the resealable slit is configured to increase or decrease the cross-sectional area of the inlet and not the cross-sectional area of the outlet.

* * * * *